US008388115B2

(12) United States Patent
Cheng et al.

(10) Patent No.: US 8,388,115 B2
(45) Date of Patent: Mar. 5, 2013

(54) PIEZOELECTRIC INKJET HEAD STRUCTURE

(75) Inventors: Chiang-Ho Cheng, Hsinchu (TW); Chi-Feng Huang, Hsinchu (TW)

(73) Assignee: Microjet Technology Co., Ltd, Hsinchu (TW)

( * ) Notice: Subject to any disclaimer, the term of this patent is extended or adjusted under 35 U.S.C. 154(b) by 0 days.

(21) Appl. No.: 13/218,917

(22) Filed: Aug. 26, 2011

(65) Prior Publication Data

US 2012/0062657 A1 Mar. 15, 2012

(30) Foreign Application Priority Data

Sep. 9, 2010 (CN) ..... 2010 1 0282240
Sep. 9, 2010 (CN) ..... 2010 1 0282243

(51) Int. Cl.
*B41J 2/045* (2006.01)

(52) U.S. Cl. ..... 347/68; 347/69; 347/71; 347/72

(58) Field of Classification Search ..... 347/68–72
See application file for complete search history.

(56) References Cited

U.S. PATENT DOCUMENTS 6,107,726 A * 8/2000 Near et al. ..... 310/328
6,188,416 B1 * 2/2001 Hayes ..... 347/71

* cited by examiner

*Primary Examiner* — Matthew Luu
*Assistant Examiner* — Henok Legesse

(57) ABSTRACT

A piezoelectric inkjet head structure includes an upper cover plate, a lower cover plate, a piezoelectric actuating module, a nozzle plate and a seal layer. The piezoelectric actuating module includes an upper piezoelectric chip, a lower piezoelectric chip, a first electrode, a second electrode, a conductive layer and a plurality of flow channels. The entrances of the flow channels of the upper piezoelectric chip and the lower piezoelectric chip are separated from each other by the same spacing interval. The entrances of the flow channels of the upper piezoelectric chip and the entrances of the flow channels of the lower piezoelectric chip are arranged in a staggered form. During operation of the piezoelectric actuating module, ink liquid is introduced into the flow channels of the piezoelectric actuating module from the upper cover plate and the lower cover plate, and then ejected out of the nozzles.

8 Claims, 10 Drawing Sheets

PIEZOELECTRIC INKJET HEAD STRUCTURE

FIELD OF THE INVENTION

The present invention relates to an inkjet head structure, and more particularly to a piezoelectric inkjet head structure.

BACKGROUND OF THE INVENTION

With increasing development of an inkjet technology, the inkjet technology is not only used in the traditional printer market but also used in flat panel displays and semiconductor manufacturing processes in recent years. However, for reducing the fabricating cost and saving the process time, researchers are seeking new inkjet technologies. As known, a piezoelectric inkjet technology is one of the most widely-used new inkjet technologies.

Conventionally, the piezoelectric inkjet head structure comprises a nozzle plate, a cover plate and a piezoelectric actuating module. Please refer to FIGS. 1A and 1B. The conventional piezoelectric actuating module 1 comprises an upper piezoelectric chip 11, a lower piezoelectric chip 12, and two electrodes 13 and 14. The electrode 13 is disposed on the upper piezoelectric chip 11. The electrode 14 is disposed on the lower piezoelectric chip 12. In addition, a conductive layer 15 is arranged between the two electrodes 13 and 14. For example, the conductive layer 15 is a conductive adhesive for connecting the two electrodes 13 and 14 with each other. The conventional piezoelectric actuating module 1 further comprises a plurality of flow channels 16*a*, 16*b* and 16*c*. These flow channels 16*a*, 16*b* and 16*c* extend downwardly from the upper piezoelectric chip 11 to the lower piezoelectric chip 12. The entrances 161 of these flow channels are all located at the upper piezoelectric chip 11.

Please refer to FIG. 1B, which schematically illustrates the actions of the conventional piezoelectric actuating module. During operation of the piezoelectric actuating module 1, the electrodes 13 and 14 generate an electric field. According to the positive and negative voltages, the electric field causes deformation of the upper piezoelectric chip 11 and the lower piezoelectric chip 12. As shown in FIG. 1B, when opposite voltages are applied on both sides of the upper piezoelectric chip 11 and the lower piezoelectric chip 12, the flow channel 16*b* is expanded. As the flow channel 16*b* is expanded, the flow channels 16*a* and 16*c* at bilateral sides of the flow channel 16*b* are compressed. Consequently, the ink liquid (not shown) contained in the flow channels 16*a* and 16*c* will be ejected out through a nozzle (not shown). Moreover, since the flow channel 16*b* is expanded, the ink liquid (not shown) will be introduced into the flow channel 16*b*. By alternately changing the positive and negative voltages, the ink liquid can be ejected out through different flow channels 16 and corresponding nozzles (not shown).

In the conventional piezoelectric actuating module 1 as shown in FIGS. 1A and 1B, the flow channels 16*a*, 16*b* and 16*c* are extended downwardly from the upper piezoelectric chip 11 to the lower piezoelectric chip 12, and the entrances 161 of these flow channels are all located at the upper piezoelectric chip 11. Consequently, the base part 121 between every two adjacent ones of the flow channels 16*a*, 16*b* and 16*c* is relatively weak. Since the flow channels 16*a*, 16*b* and 16*c* are expanded or compressed during the operations of the conventional piezoelectric actuating module 1, the base parts 121 beside the flow channels 16*a*, 16*b* and 16*c* are adversely affected. Since the base parts 121 are frequently subject to deformation and compression, the base parts 121 are readily damaged. Under this circumstance, the performance of the conventional piezoelectric actuating module 1 is deteriorated, and thus the piezoelectric inkjet head structure is possibly damaged.

Therefore, there is a need of providing a piezoelectric inkjet head structure with a strong structural strength so as to minimize the damaging possibility.

SUMMARY OF THE INVENTION

The present invention provides a piezoelectric inkjet head structure, in which the entrances of the flow channels of the piezoelectric actuating module are separated from each other by the same spacing interval and arranged in a staggered form. In such way, the structural strength of the piezoelectric actuating module becomes stronger, and the possibility of damaging the piezoelectric inkjet head structure is minimized.

In accordance with an aspect of the present invention, there is provided a piezoelectric inkjet head structure. The piezoelectric inkjet head structure includes an upper cover plate, a lower cover plate, a piezoelectric actuating module, a nozzle plate and a seal layer. The piezoelectric actuating module includes an upper piezoelectric chip, a lower piezoelectric chip, a first electrode, a second electrode, a conductive layer and a plurality of flow channels. The first electrode is formed on a surface of the upper piezoelectric chip. The second electrode is formed on a surface of the lower piezoelectric chip. The conductive layer is formed between the first electrode and the second electrode. The upper piezoelectric chip and the lower piezoelectric chip are connected with each other through the conductive layer. The flow channels are formed in the upper piezoelectric chip and the lower piezoelectric chip. The entrances of the flow channels of the upper piezoelectric chip are separated from each other by the same spacing interval. The entrances of the flow channels of the lower piezoelectric chip are separated from each other by the same spacing interval. The entrances of the flow channels of the upper piezoelectric chip and the entrances of the flow channels of the lower piezoelectric chip are arranged in a staggered form. The nozzle plate includes a plurality of nozzles, which are located at first ends of the flow channels. The seal layer is located at second ends of the flow channels. The upper cover plate and the lower cover plate are respectively located at a top side and a bottom side of the piezoelectric actuating module. During operation of the piezoelectric actuating module, ink liquid is introduced into the flow channels of the piezoelectric actuating module from the upper cover plate and the lower cover plate, and then ejected out of the nozzles.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
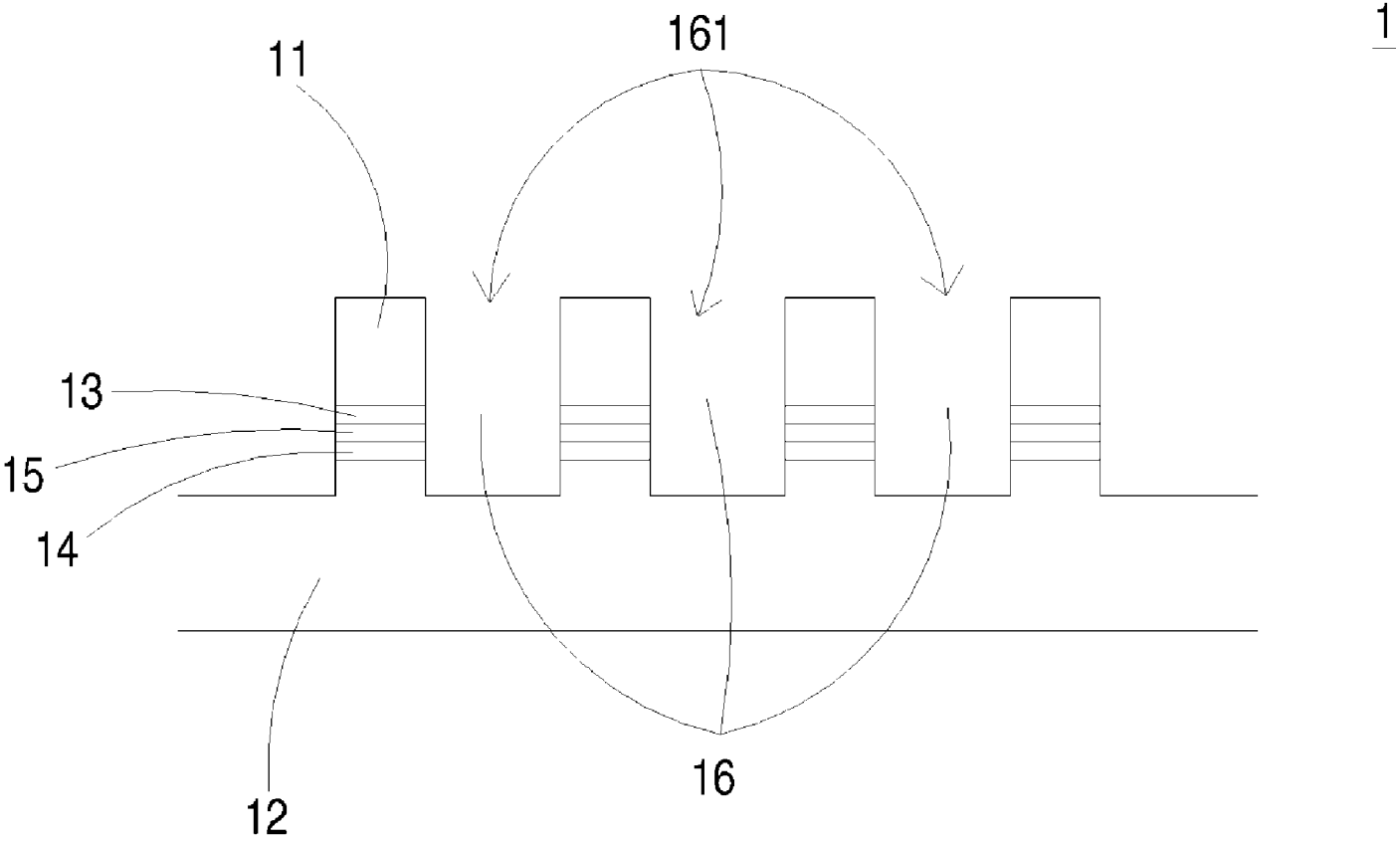
FIG. 1A PRIOR ART
FIG. 1A schematically illustrates the architecture of a piezoelectric actuating module of a conventional piezoelectric inkjet head structure.
Figure 1B:
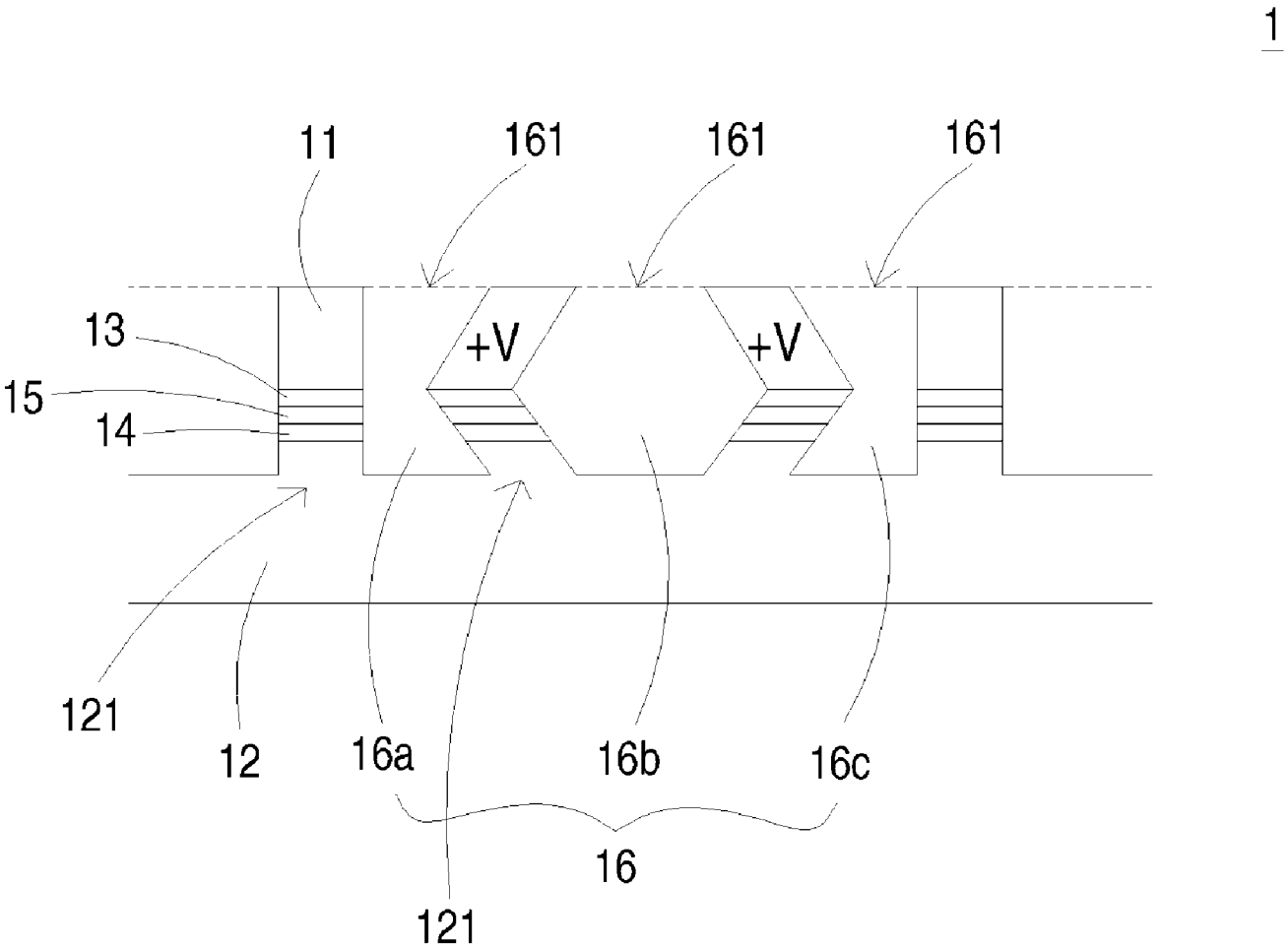
FIG. 1B PRIOR ART
FIG. 1B schematically illustrates the actions of the piezoelectric actuating module as shown in FIG. 1A.
Figure 2:
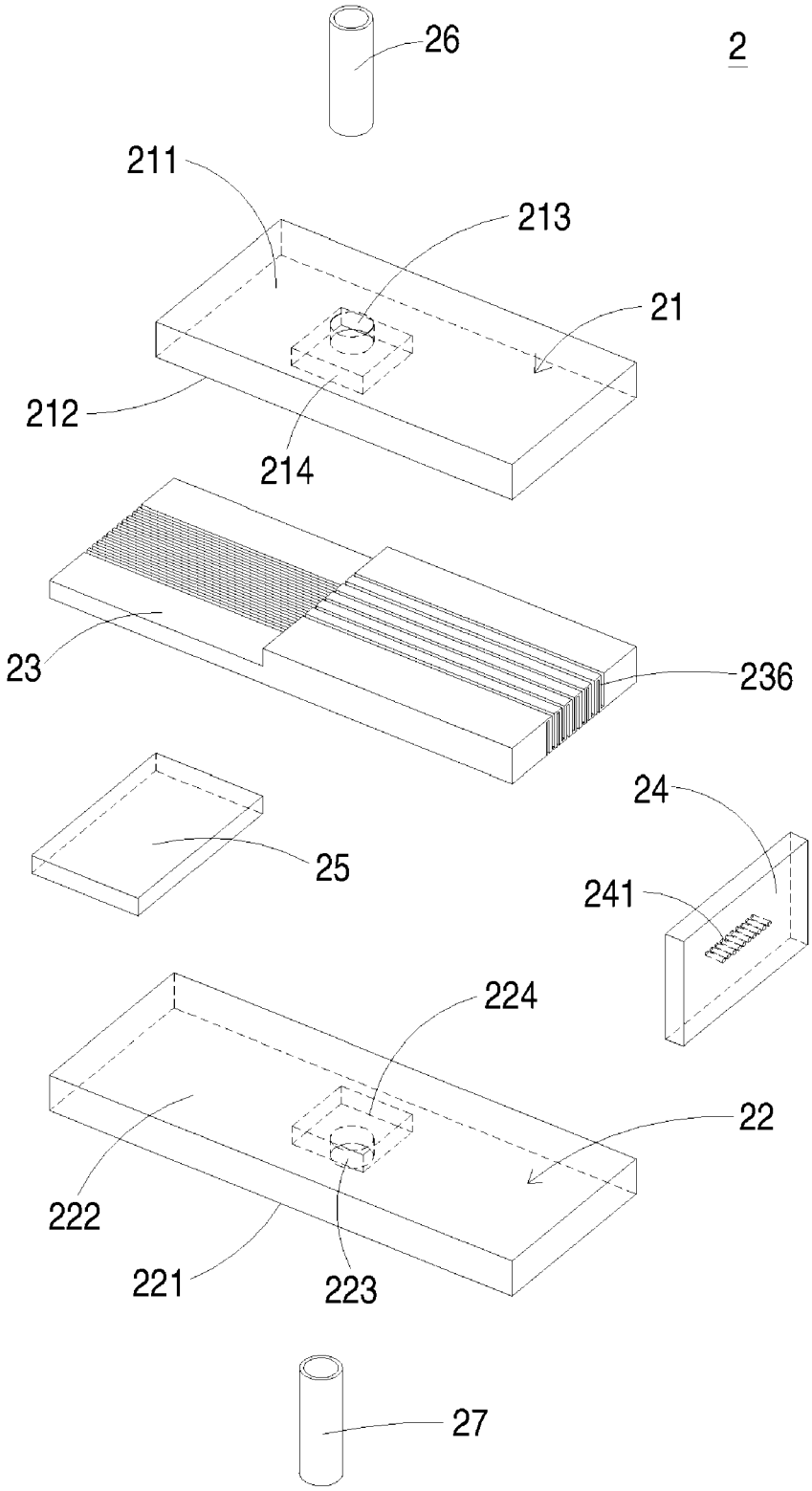
FIG. 2 is a schematic exploded view illustrating a piezoelectric inkjet head structure according to an embodiment of the present invention.
Figure 3:
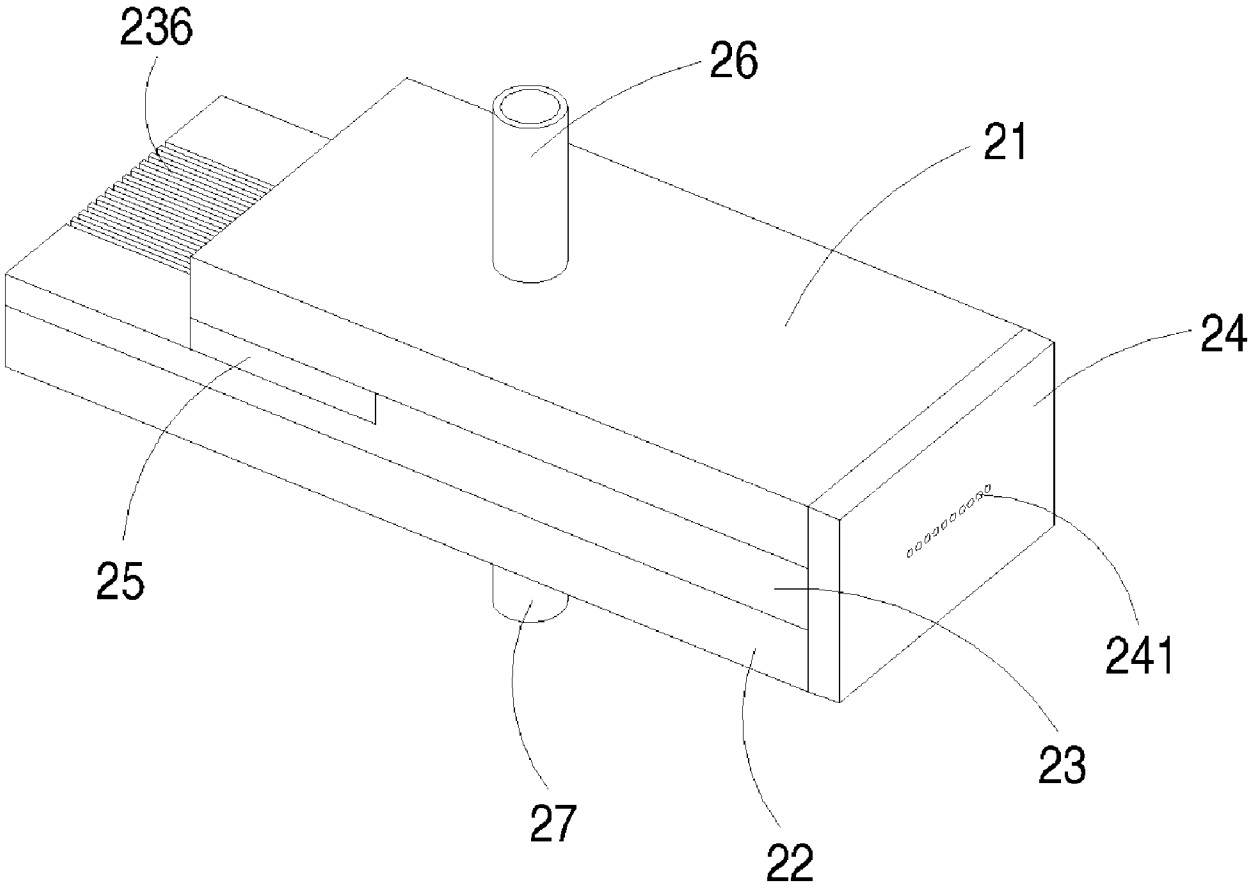
FIG. 3 is a schematic assembled view illustrating the piezoelectric inkjet head structure of FIG. 2.

Please refer to FIGS. 2 and 3. The piezoelectric inkjet head structure 2 of the present invention comprises an upper cover plate 21, a lower cover plate 22, a piezoelectric actuating module 23, a nozzle plate 24 and a seal layer 25. The upper cover plate 21 and the lower cover plate 22 are located at a top side and a bottom side of the piezoelectric actuating module 23, respectively. The upper cover plate 21 has a first surface 211 and a second surface 212. The lower cover plate 22 has a first surface 221 and a second surface 222. An ink inlet 213 is located at the first surface 211 of the upper cover plate 21. In addition, another ink inlet 223 is located at the first surface 221 of the lower cover plate 22. Two ink-guiding manifolds 214 and 224 are formed in the second surfaces 212 and 222, respectively. A first end of the ink inlet 213 is in communication with an input ink channel 26. Similarly, a first end of the ink inlet 223 is in communication with an input ink channel 27. A second end of the ink inlet 213 is in communication with the ink-guiding manifold 214. Similarly, a second end of the ink inlet 223 is in communication with the ink-guiding manifold 224. The piezoelectric actuating module 23 has a plurality of flow channels 236. The nozzle plate 24 has a plurality of nozzles 241. The first ends of the flow channels 236 are in communication with the nozzles 241 of the nozzle plate 24. The second ends of the flow channels 236 are sealed by the seal layer 25. In some embodiments, the seal layer 25 is a seal gel (e.g. a silica gel) for sealing the distal ends of the flow channels 236. In the assembled structure of the piezoelectric inkjet head structure 2, the upper cover plate 21 and the lower cover plate 22 are respectively aligned with the top side and the bottom side of the piezoelectric actuating module 23, and the nozzle plate 24 is aligned with the outlet side of the flow channels 236 of the piezoelectric actuating module 23. Afterwards, the seal layer 25 is aligned with the distal ends of the flow channels 236 to prevent ink leakage. The resulting assembled structure of the piezoelectric inkjet head structure 2 is shown in FIG. 3. In some embodiment, the nozzle plate 24 is attached on the piezoelectric actuating module 23 through a bonding medium (e.g. a structural gel). The operation of ejecting ink liquid by the piezoelectric inkjet head structure 2 will be illustrated as follows. Firstly, ink liquid is introduced into the inner portions of the upper cover plate 21 and the lower cover plate 22 through the input ink channels 26 and 27. Then, the ink liquid is guided to the flow channels 236 of the piezoelectric actuating module 23 by the ink-guiding manifold 214 of the upper cover plate 21 and the ink-guiding manifold 224 of the lower cover plate 22. Afterwards, through the actuating actions of the piezoelectric actuating module 23, the ink liquid is ejected out through the nozzles 241.

Figure 4A:
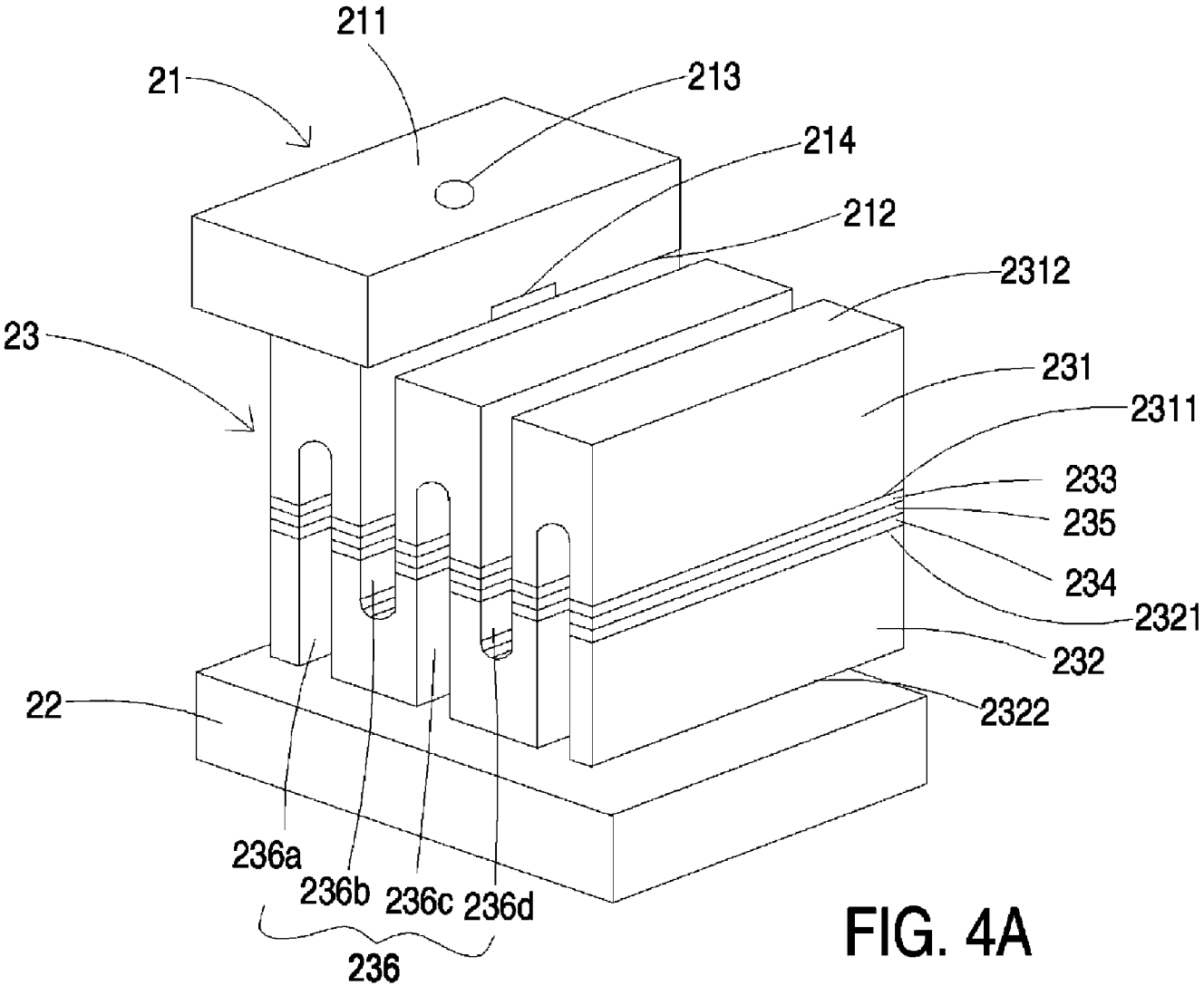
FIG. 4A schematically illustrates the piezoelectric actuating module of the piezoelectric inkjet head structure of the present invention.

As shown in FIG. 4A, the piezoelectric actuating module 23 of the piezoelectric inkjet head structure of the present invention comprises an upper piezoelectric chip 231, a lower piezoelectric chip 232, a first electrode 233, a second electrode 234, a conductive layer 235 and a plurality of flow channels 236. In the piezoelectric actuating module 23, the upper piezoelectric chip 231 and the lower piezoelectric chip 232 are made of piezoelectric material. For example, the piezoelectric material is lead zirconate titanate (PZT) with high d31 coefficient. By using a proper mold and a hydraulic machine, the piezoelectric material is pressed as a sheet-like structure so as to form the upper piezoelectric chip 231 and the lower piezoelectric chip 232. Then, a double-side grinding machine to grind the upper piezoelectric chip 231 and the lower piezoelectric chip 232 to have desired thicknesses. In some embodiments, the thicknesses of the upper piezoelectric chip 231 and the lower piezoelectric chip 232 are both 500 micrometers. After the upper piezoelectric chip 231 and the lower piezoelectric chip 232 are formed, a first electrode 233 is formed on a first surface 2311 of the upper piezoelectric chip 231, and a second electrode 234 is formed on a first surface 2321 of the lower piezoelectric chip 232. In some embodiment, during the process of forming the first electrode 233 and the second electrode 234, a temporary electrode is previously formed by coating the first surfaces 2311 and 2321 of the upper piezoelectric chip 231 and the lower piezoelectric chip 232 with an electrode material (e.g. a single-dose high-temperature plastic silver-palladium paste). Then, the upper piezoelectric chip 231 and the lower piezoelectric chip 232 with the electrode material are subject to a high-temperature firing process (e.g. at a high temperature of 600° C.) and sent to a high-temperature insulating silicone oil tank. By applying to a voltage (e.g. 3V/μm) and carrying out a polarization process for 10 minutes, a temporary electrode is formed on the first surface 2311 of the upper piezoelectric chip 231, and another temporary electrode is formed on the first surface 2321 of the lower piezoelectric chip 232. Then, the temporary electrodes are removed by grinding. Then, another electrode material such as gold/chrome (Au/Cr) material is deposited on the first surfaces 2311 and 2321 of the upper piezoelectric chip 231 and the lower piezoelectric chip 232 by a lift-off process. Meanwhile, the first electrode 233 and the second electrode 234 are formed.

Figure 4B:
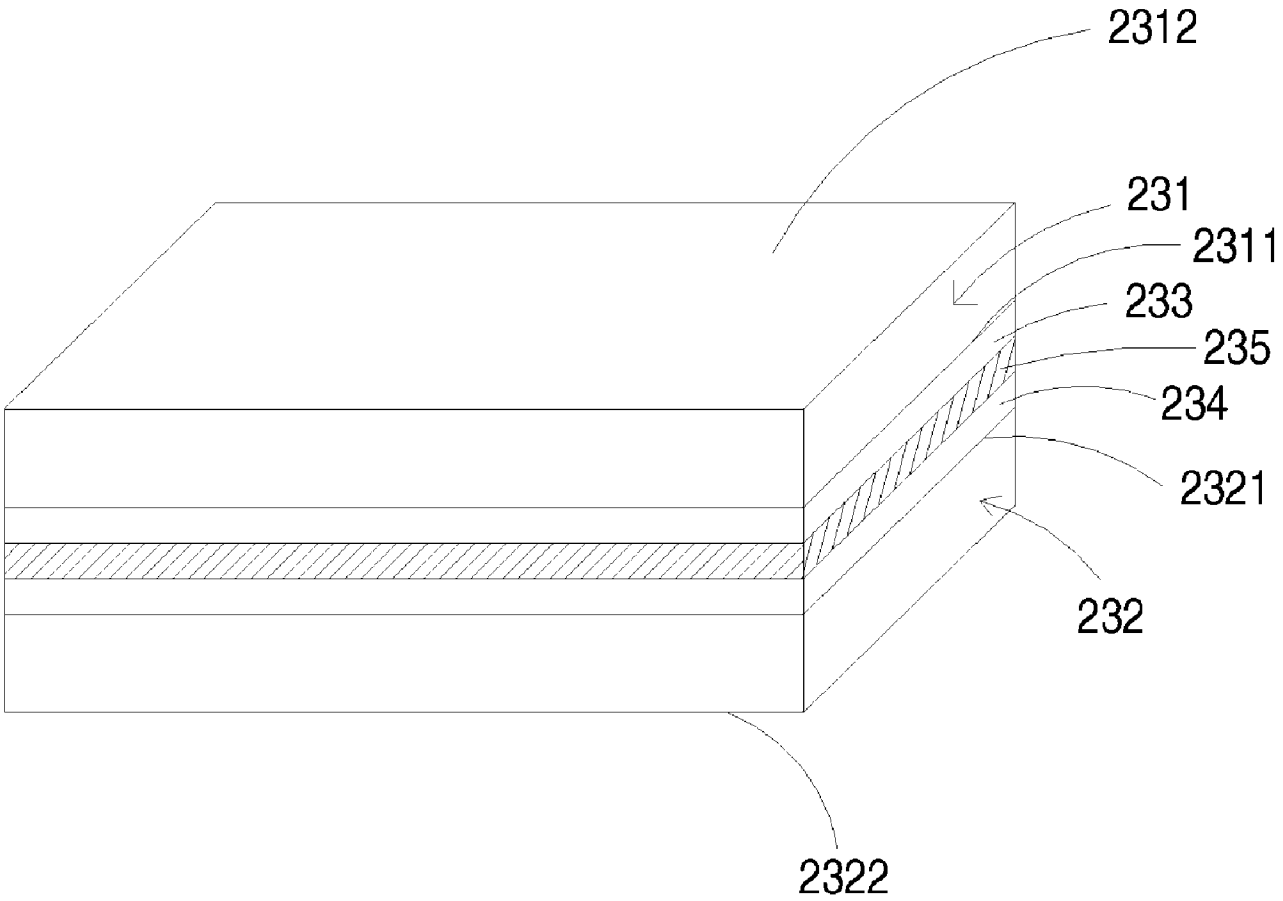
FIG. 4B schematically illustrates a combination structure of an upper piezoelectric chip and a lower piezoelectric chip of the piezoelectric actuating module.

Then, by a cutting tool (e.g. a wafer sawing machine), the upper piezoelectric chip 231 and the lower piezoelectric chip 232 with the first electrode 233 and the second electrode 234 are cut into desired size (e.g. 7 mm×20 mm×0.5 mm). The size may be varied according to the practical requirements. After the upper piezoelectric chip 231 and the lower piezoelectric chip 232 are cut into desired size, the first electrode 233 (on the firsts surface 2311 of the upper piezoelectric chip 231) and the second electrode 234 (on the first surface 2321 of the lower piezoelectric chip 232) are connected with each other through a conductive layer 235. In some embodiments, the conductive layer 235 is a conductive adhesive. Consequently, the conductive layer 235 may be spread on a region between the first electrode 233 and the second electrode 234 by a screen printing technology. Through the conductive adhesive, the first electrode 233 and the second electrode 234 may be led to the upper cover plate 21 and the lower cover plate 22, and the upper piezoelectric chip 231 and the lower piezoelectric chip 232 may be combined together. The combination structure of the upper piezoelectric chip 231 and the lower piezoelectric chip 232 is shown in FIG. 4B.

Figure 4C:
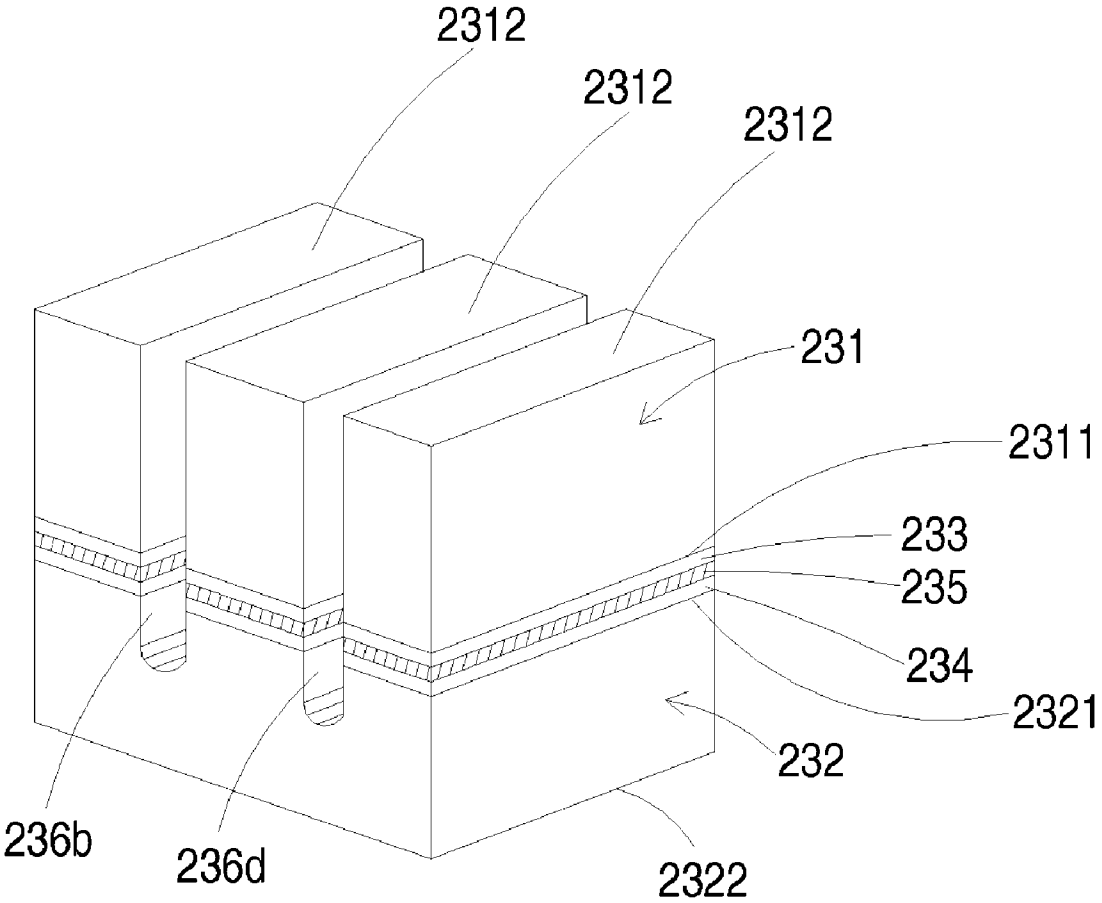
FIG. 4C schematically illustrates the flow channels formed in the upper piezoelectric chip of the piezoelectric actuating module.
Figure 4D:
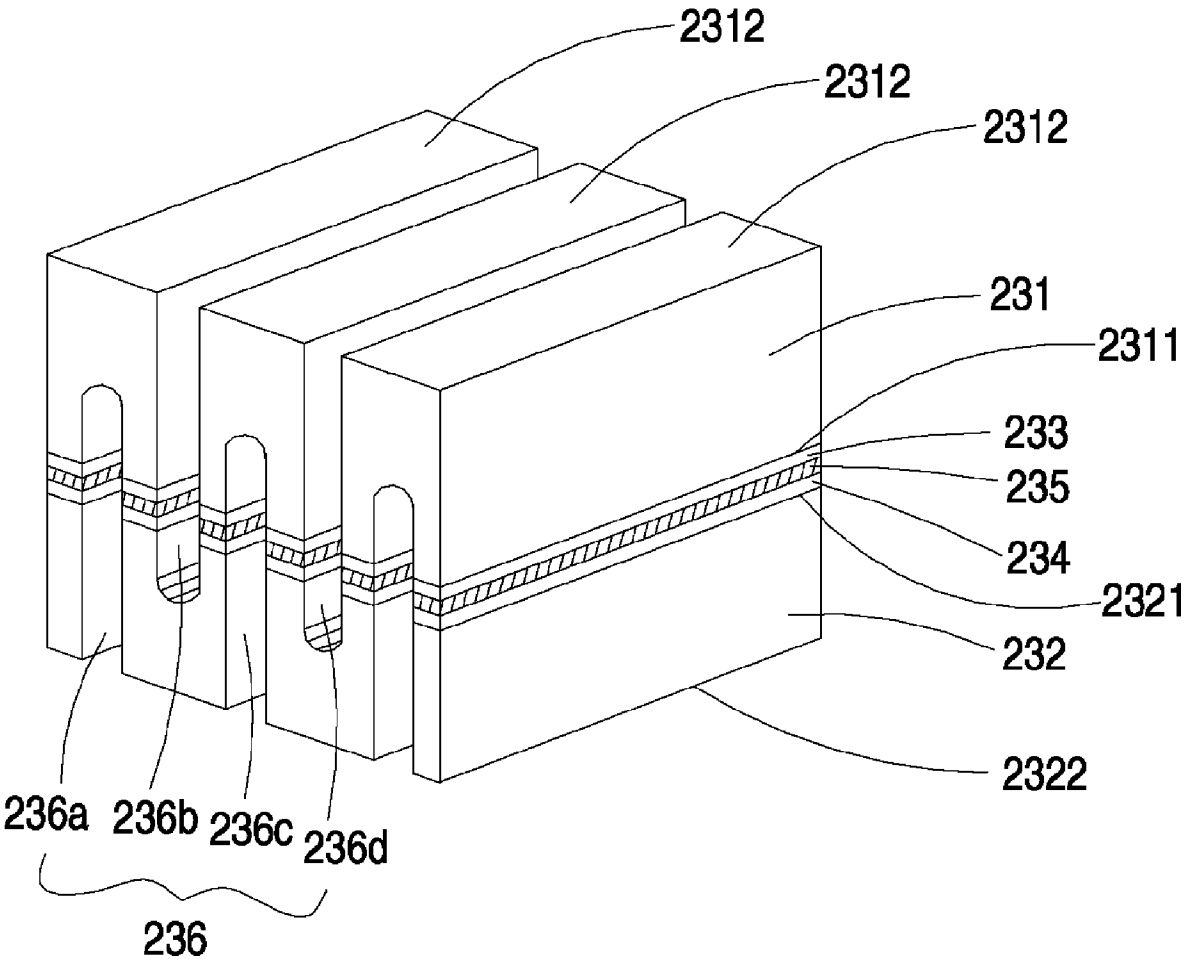
FIG. 4D schematically illustrates the flow channels formed in the upper piezoelectric chip and the lower piezoelectric chip of the piezoelectric actuating module.

After the upper piezoelectric chip 231 and the lower piezoelectric chip 232 are combined together, an upward cutting process and a downward cutting process are performed to define a plurality of flow channels 236*a*, 236*b*, 236*c* and 236*d* in the piezoelectric actuating module 23. By using the upward cutting process to cut the upper piezoelectric chip 231 at the same spacing intervals, the flow channels 236*b* and 236*d* extending from a second surface 2312 of the upper piezoelectric chip 231 to the lower piezoelectric chip 232 are created (see FIG. 4C). Then, by using the downward cutting process to cut the lower piezoelectric chip 232 at the same spacing interval, the flow channels 236*a* and 236*c* extending from a second surface 2322 of the lower piezoelectric chip 232 to the upper piezoelectric chip 231 are created (see FIG. 4D). As shown in FIG. 4D, the flow channels 236*a*, 236*b*, 236*c* and 236*d* are arranged in a staggered form.

Figure 5A:
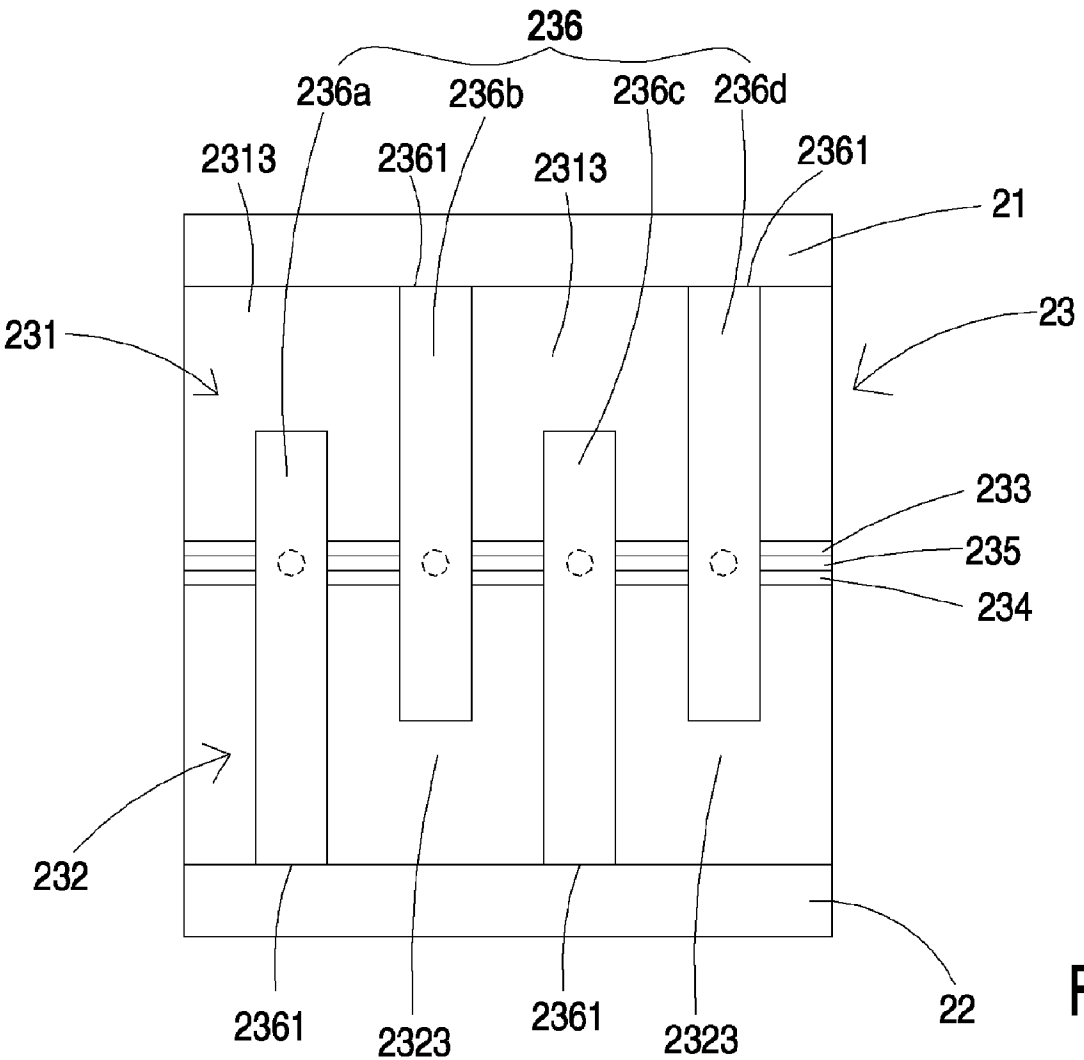
FIG. 5A is a schematic cross-sectional view illustrating the piezoelectric actuating module of the present invention.

Due to the two equidistant and staggered cutting processes, the flow channels 236*a*, 236*b*, 236*c* and 236*d* of the piezoelectric actuating module 23 are separated from each other by the same spacing interval and arranged in a staggered form. As shown in FIG. 5A, the entrances 2361 of these flow channels 236*a*, 236*b*, 236*c* and 236*d* are not located at the same piezoelectric chip. Especially, the entrances 2361 of these flow channels 236*a*, 236*b*, 236*c* and 236*d* are arranged at the upper piezoelectric chip 231 and the lower piezoelectric chip 232 in a staggered form. Since the both sides of each of the flow channels 236*a*, 236*b*, 236*c* and 236*d* are supporting structures. Due to the strong strength of the supporting structures, the distance between every two flow channels may be reduced. That is, since the flow channels 236*a*, 236*b*, 236*c* and 236*d* of the piezoelectric actuating module 23 are separated from each other by the same spacing interval and arranged in a staggered form, the structural strength is increased to avoid damage during the machining process. Under this circumstance, the material cost of fabricating the piezoelectric actuating module 23 will be reduced.

Please refer to FIG. 4A again. After the upper cover plate 21 is placed on the piezoelectric actuating module 23, the ink liquid may flows from the ink inlet 213 (at the first surface 211 of the upper cover plate 21) to the ink-guiding manifold 214 (at the second surface 212 of the upper cover plate 21). Since the ink-guiding manifold 214 is disposed over the flow channels 236*b* and 236*d*, the ink liquid can be uniformly introduced from the ink-guiding manifold 214 into the flow channels 236*b* and 236*d* of the upper piezoelectric chip 231 through the entrances 2361. Similarly, the ink liquid can be uniformly introduced from the ink-guiding manifold 224 (see FIG. 2) into the flow channels 236*a* and 236*c* of the lower piezoelectric chip 232 through the entrances 2361. In such way, the ink liquid can be transferred to the flow channels 236 of the piezoelectric actuating module 23 through the ink inlets 213, 223 and the ink-guiding manifolds 214, 224 of the upper cover plate 21 and the lower cover plate 22.

Hereinafter, the actions of the piezoelectric actuating module will be illustrated with reference to FIGS. 5A and 5B. As shown in FIG. 5A, the entrances 2361 of the flow channels 236*b* and 236*d* of the piezoelectric actuating module 23 are located at the upper piezoelectric chip 231, and the entrances 2361 of the flow channels 236*a* and 236*c* are located at the lower piezoelectric chip 232. That is, the entrances 2361 of these flow channels 236*a*, 236*b*, 236*c* and 236*d* are arranged at the upper piezoelectric chip 231 and the lower piezoelectric chip 232 in a staggered form. Regardless of whether the flow channels 236*a*, 236*b*, 236*c* and 236*d* are located at the base part 2313 of the upper piezoelectric chip 231 or the base part 2323 of the lower piezoelectric chip 232, the flow channels 236*a*, 236*b*, 236*c* and 236*d* are well supported. When an electric field is generated between the first electrode 233 of the upper piezoelectric chip 231 and the second electrode 234 of the lower piezoelectric chip 232, different positive and negative voltages are applied to the sidewalls at both sides of the corresponding flow channel 236. According to different positive and negative voltages, the flow channels 236 have different deformation degrees.

Figure 5B:
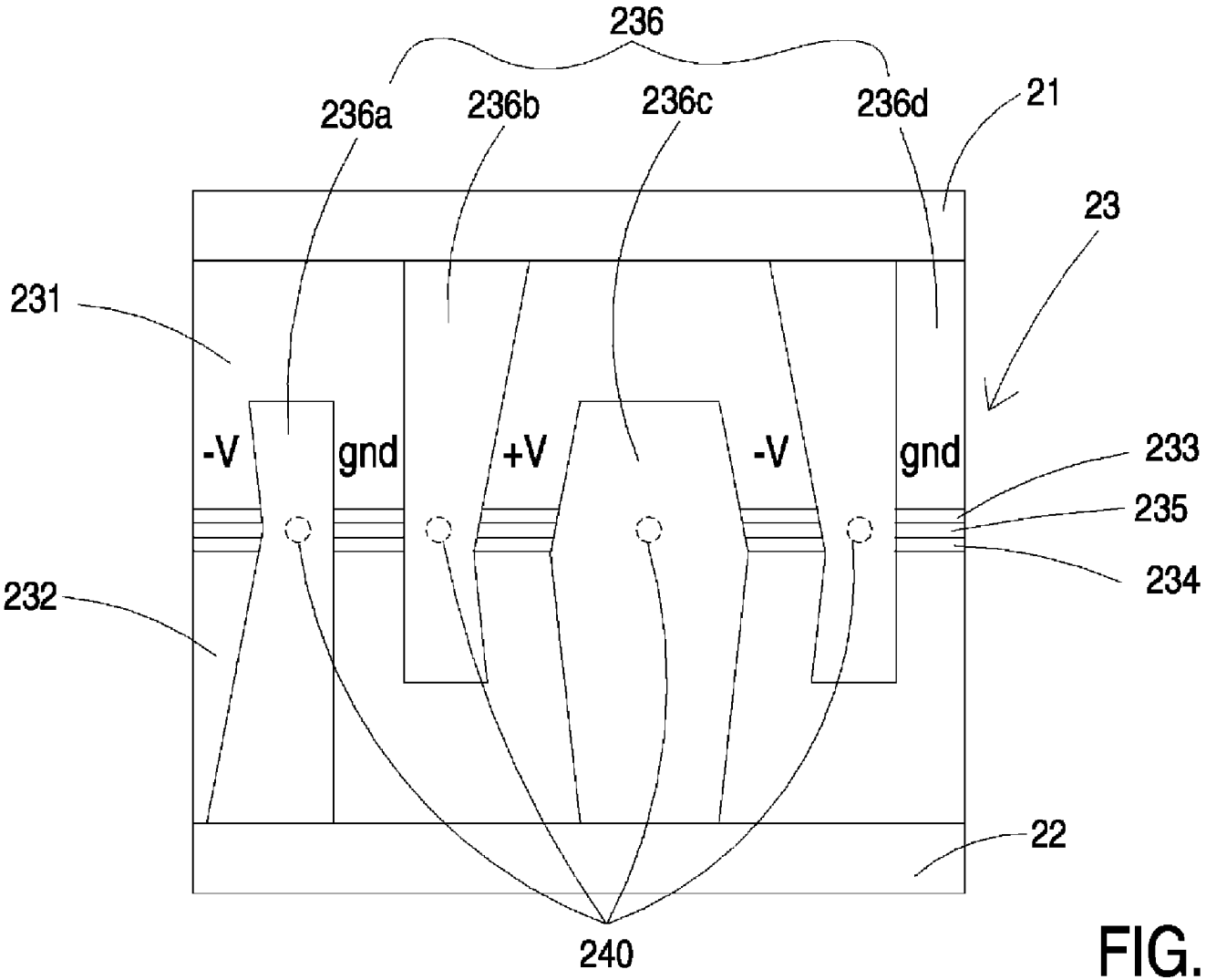
FIG. 5B schematically illustrates the actions of the piezoelectric actuating module as shown in FIG. 5A.

For example, as shown in FIG. 5B, the both sides of the flow channel 236*c* have a positive voltage and a negative voltage, respectively. Consequently, the flow channel 236*c* is deformed and expanded. As the flow channel 236*c* is expanded, the flow channels 236*b* and 236*d* are compressed. Since the opposite sides of the flow channels 236*b* and 236*d* are ground terminals, the sides corresponding to the ground terminals are not subject to deformation. Since the sides of the flow channels 236*b* and 236*d* adjacent to the expanded flow channel 236*c* are compressed, the ink liquid contained in the flow channels 236*b* and 236*d* will be ejected out through the corresponding nozzles 241. Similarly, the flow channel 236*a* is compressed and deformed by another adjacent flow channel (not shown), the ink liquid contained in the flow channel 236*a* will be ejected out through the corresponding nozzle 241. Since the flow channel 236*c* is deformed and expanded, the attractive force arising from the expanded deformation causes the ink liquid to flow into the flow channel 236*c* from the ink-guiding manifold 224 (see FIG. 4). From the above discussions, due to the change of the electric field of the piezoelectric actuating module 23, the flow channels 236*a*, 236*b*, 236*c* and 236*d* are subject to deformation or kept unchanged. In such way, the ink liquid is controlled to be ejected out the flow channels 236 or introduced into the flow channels 236 to implement the piezoelectric inkjet printing task.

From the above description, the piezoelectric inkjet head structure of the present invention has a specified piezoelectric actuating module. Since the entrances of the flow channels of the piezoelectric actuating module are separated from each other by the same spacing interval and arranged in a staggered form, the structural strength of the piezoelectric actuating module is enhanced. Due to the strong structural strength, the distance between every two flow channels will be reduced. Consequently, the overall volume and the material amount of the piezoelectric actuating module are both reduced, and the fabricating cost is reduced. Moreover, the piezoelectric actuating module is structurally stable, and the possibility of damaging the piezoelectric actuating module is minimized. In views of the above benefits, the piezoelectric inkjet head structure of the present invention is advantageous over the conventional piezoelectric inkjet head.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A piezoelectric inkjet head structure, comprising:

an upper cover plate;

a lower cover plate;

a piezoelectric actuating module comprising:

an upper piezoelectric chip;

a first electrode formed on a surface of said upper piezoelectric chip;

a lower piezoelectric chip;

a second electrode formed on a surface of said lower piezoelectric chip;

a conductive layer formed between said first electrode and said second electrode, wherein said upper piezoelectric chip and said lower piezoelectric chip are connected with each other through said conductive layer; and a plurality of flow channels formed in said upper piezoelectric chip and said lower piezoelectric chip, wherein the entrances of said flow channels of said upper piezoelectric chip are separated from each other by the same spacing interval and are extended from the upper piezoelectric chip to the lower piezoelectric chip, the entrances of said flow channels of said lower piezoelectric chip are separated from each other by the same spacing interval and are extended from the lower piezoelectric chip to the upper piezoelectric chip, and the entrances of said flow channels of said upper piezoelectric chip and the entrances of said flow channels of said lower piezoelectric chip are arranged in a staggered form;

a nozzle plate comprises a plurality of nozzles, which are located at first ends of said flow channels; and a seal layer located at second ends of said flow channels, wherein said upper cover plate and said lower cover plate are respectively located at a top side and a bottom side of said piezoelectric actuating module, wherein during operation of said piezoelectric actuating module, ink liquid is introduced into said flow channels of said piezoelectric actuating module from said upper cover plate and said lower cover plate, and then ejected out of said nozzles.

2. The piezoelectric inkjet head structure according to claim 1 wherein each of said upper cover plate and said lower cover plate includes a first surface and a second surface, wherein an ink inlet is located at said first surface, an ink-guiding manifold is located at said second surface, and said ink-guiding manifold is disposed over said flow channels for uniformly introducing said ink liquid into said flow channels.

3. The piezoelectric inkjet head structure according to claim 1 wherein the entrances of said flow channels of said upper piezoelectric chip and the entrances of said flow channels of said lower piezoelectric chip are produced by an upward cutting process and a downward cutting process in a staggered arrangement.

4. The piezoelectric inkjet head structure according to claim 1 wherein said conductive layer is a conductive adhesive.

5. The piezoelectric inkjet head structure according to claim 1 wherein said upper piezoelectric chip and said lower piezoelectric chip are made lead zirconate titanate piezoelectric material.

6. The piezoelectric inkjet head structure according to claim 1 wherein said first electrode and said second electrode are respectively formed on surfaces of said upper piezoelectric chip and said lower piezoelectric chip by depositing a gold/chrome material.

7. The piezoelectric inkjet head structure according to claim 2 further comprising a plurality of input ink channels, wherein said input ink channels are in communication with said ink inlets of said upper cover plate and said lower cover plate for introducing said ink liquid.

8. A piezoelectric actuating module of a piezoelectric inkjet head structure, said piezoelectric actuating module comprising:

an upper piezoelectric chip;

a first electrode formed on a surface of said upper piezoelectric chip;

a lower piezoelectric chip;

a second electrode formed on a surface of said lower piezoelectric chip;

a conductive layer formed between said first electrode and said second electrode, wherein said upper piezoelectric chip and said lower piezoelectric chip are connected with each other through said conductive layer; and a plurality of flow channels formed in said upper piezoelectric chip and said lower piezoelectric chip, wherein the entrances of said flow channels of said upper piezoelectric chip are separated from each other by the same spacing interval and are extended from the upper piezoelectric chip to the lower piezoelectric chip, the entrances of said flow channels of said lower piezoelectric chip are separated from each other by the same spacing interval and are extended from the lower piezoelectric chip to the upper piezoelectric chip, and the entrances of said flow channels of said upper piezoelectric chip and the entrances of said flow channels of said lower piezoelectric chip are arranged in a staggered form.

* * * * *